US005249941A

United States Patent [19]

Shibamoto

[11] Patent Number: 5,249,941

[45] Date of Patent: Oct. 5, 1993

[54] SCROLL TYPE FLUID MACHINE HAVING INTERMITTENT OIL FEED TO WORKING CHAMBER

[75] Inventor: Yoshitaka Shibamoto, Sakai, Japan

[73] Assignee: Daikin Industries, Ltd., Osaka, Japan

[21] Appl. No.: 897,384

[22] Filed: Jun. 12, 1992

[30] Foreign Application Priority Data

Jun. 13, 1991 [JP] Japan ..... 3-141935
Oct. 1, 1991 [JP] Japan ..... 3-253629

[51] Int. Cl.[5] ..... F01C 1/04; F01C 21/04

[52] U.S. Cl. ..... 418/55.5; 418/55.6; 418/57; 418/99

[58] Field of Search ..... 418/55.5, 55.6, 57, 418/94, 97-99

[56] References Cited

U.S. PATENT DOCUMENTS 4,568,256 2/1986 Blain ..... 418/55.6
4,648,814 3/1987 Shiibayashi ..... 418/55.6
4,795,321 1/1989 Etemad et al. ..... 418/1
5,101,644 4/1992 Crum et al. ..... 418/55.6

FOREIGN PATENT DOCUMENTS 0217349 4/1987 European Pat. Off. .
3518639 11/1985 Fed. Rep. of Germany .
58-170872 10/1983 Japan .
58-170878 10/1983 Japan .
59-29790 2/1984 Japan .
59-93982 5/1984 Japan .
59-185892 10/1984 Japan .
62-3184 1/1987 Japan ..... 418/55.6
3-11181 1/1991 Japan ..... 418/55.6
3-88988 4/1991 Japan .

*Primary Examiner*—John J. Vrablik
*Attorney, Agent, or Firm*—Birch, Stewart, Kolasch & Birch

[57] ABSTRACT

A scroll type fluid machine is provided with a mechanism for injecting oil into fluid working chambers such that a precise amount of oil is supplied without using any capillary tube, instead using intermittent oil feed from an oil sump through a communicating passage into the working chambers. Within a sealed casing, a first scroll having a spiral ridge and a second scroll having a spiral ridge are interleaved forming working chambers therebetween. A precise amount of oil is supplied to the working chambers from an oil sump which is in flow communication with an oil feed chamber provided on the end face of a cylinder member which is in sliding contact with the end plate of the second scroll. The oil feed chamber is in intermittent flow communication with a communicating passage which intermittently connects the oil feed chamber to the working chambers as the second scroll revolves.

12 Claims, 13 Drawing Sheets

Pd = 2.0 MPa
Ps = 0.5 MPa $P_1$ = 0.8 MPa
$P_2$ = 1.8 MPa
$P_3$ = 0.5 MPa
$P_4$ = 0.7 MPa $\theta_1$ = 150°
$\theta_2$ = 450°
$\theta_3$ = 10°
$\theta_4$ = 140°

SCROLL TYPE FLUID MACHINE HAVING INTERMITTENT OIL FEED TO WORKING CHAMBER

BACKGROUND OF THE INVENTION

1. Field of the Invention

The present invention relates to a scroll type fluid machine which injects oil into fluid working chambers, where refrigerant compression and other work are carried out, so as to seal the fluid working chambers.

2. Description of the Prior Art

It has been conventional practice, for example as disclosed in Japanese Patent Laid-Open Publication No. 88988/1991 and shown in FIG. 20, that a sealed casing D of high-pressure resistant cylinder type is internally provided with a stationary scroll A and a movable scroll B each having spiral ridges a and b, respectively, wherein a low-pressure gas taken in a spiral-peripheral portion via a suction tube L is compressed in fluid working chambers C defined between the spiral ridges a and b, and then the compressed high-pressure gas is released into the sealed casing D through a discharge hole H provided at the center of the stationary scroll A. Also, to hermetically seal the inside of the fluid working chambers C, which varies in pressure from a low pressure range on the spiral periphery side to a high-pressure range on the spiral center side, an oil injection tube J extending from an oil sump provided at a bottom of the sealed casing D under a high-pressure atmosphere is connected to a working chamber C falling within an intermediate-pressure range, so as to enable an oil injection by differential pressure, so that oil films necessary for sealing can be formed on slidable contact surfaces between the spiral ridges a and b.

However, in the above-described arrangement, the high-pressure oil sump and the working chambers C normally communicate with each other via the oil injection tube J and, as a result, oil is always injected into the working chambers C such that the quantity of injected oil is likely to be excessive. To avoid this, the oil injection tube J must to be a small diameter. capillary tube to restrict the flow rate of the oil. Such tubes are costly and selection of the proper diameter is complicated. As a consequence, controlling the oil quantity becomes difficult.

SUMMARY OF THE INVENTION

An object of the present invention is therefore to provide a scroll type fluid machine which is devised in the way that oil is injected into fluid working chambers so that it can perform proper oil injection without using any capillary tube.

Another object of the present invention is to provide a scroll type fluid machine which is devised in the way that oil is injected into fluid working chambers so that it can perform proper oil injection into the fluid working chambers while an axial force of a second scroll toward a first scroll can be prevented from becoming excessive.

In order to achieve the aforementioned object, there is provided a scroll type fluid machine in which within a sealed casing there are disposed a first scroll having an end plate and a spiral ridge provided to a front side of the end plate as well as a second scroll having an end plate and a spiral ridge provided to a front face of the end plate in such a way that the two spiral ridges are interleaved, a back face of the end plate of the second scroll being supported by a support member secured to the sealed casing, and in which between the spiral ridges of the first and second scrolls there are formed working chambers which move from a low-pressure range on a peripheral side to a high-pressure range on a center side as volumes of the working chambers are decreased due to revolution of the second scroll relative to the first scroll, the scroll type fluid machine characterized in that:

a back side chamber is formed between the back face of the end plate of the second scroll and the support member;

a cylinder member is disposed within the back side chamber so that the back face of the end plate of the second scroll makes sliding contact with an end face of the cylinder member, thereby defining a center side chamber inside the cylinder member within the back side chamber;

an oil feed chamber is provided to the end face of the cylinder member so as to open to the back face of the end plate of the second scroll;

an oil passage is provided to the cylinder member for introducing oil into the oil feed chamber; and communicating means is provided to the end plate of the second scroll so as to be communicated with the working chamber and further intermittently communicated with the oil feed chamber as the second scroll revolves.

With the above arrangement, high-pressure oil introduced into the oil feed chamber from the oil passage is injected into the working chamber when the oil feed chamber and the communicating means come to be communicated with each other as the second scroll revolves. Since it is not during the whole period of one revolution of the second scroll but during a partial period thereof that the oil feed chamber and the communicating means are communicated with each other, the resulting quantity of oil injected into the working chamber via the communicating means is a limited one and yet a period during which the communicating means is communicated with the oil feed chamber can be easily set by selecting the position at which the communicating means is open. Accordingly, it is easy to set the quantity of oil injected.

It is preferable that the communicating means is open to the inside of the working chamber falling under an intermediate-pressure range.

With this arrangement, oil is not injected into the working chamber located in the low-pressure range but injected into the working chamber located in the intermediate-pressure range, and therefore the low-pressure gas in the working chamber located in the low-pressure range can be prevented from being heated to an excessive extent by the oil, suppressing any reduction in the volumetric efficiency.

Further, it is preferable that the oil feed chamber is provided by a ring-shaped groove provided to the cylinder member so as to surround the center of the end plate of the second scroll.

The above-described arrangement can ensure a more successful sliding characteristic between the cylinder member and the back face of the end plate of the second scroll by virtue of oil collected in the oil feed chamber formed by a ring-shaped groove.

Furthermore, it is preferable that a bottom of the back side chamber is provided .with an oil sump for receiving oil fed to a sliding part of a crank shaft which drives the second scroll, the oil sump being communicated with the oil passage of the cylinder.

The arrangement also allows the bottom of the back side chamber of the support member to be effectively utilized, permitting a passage construction for oil injection to be simplified.

Moreover, it is preferable that the oil sump is disposed so as to be located below rotation range over which a crank pin part of the crank shaft rotates, and the support member is provided with a discharge hole for discharging oil which would gather in the rotation range of the crank pin part.

The arrangement further makes it possible to prevent the oil collected in the oil sump and the crank pin from interfering with each other because any excessive oil can be discharged at the bottom of the sealed casing via the discharge hole, thus reducing any power loss due to stirring of oil.

Further, it is preferable that between the cylinder member and the support member there is provided an urging means for urging the cylinder member toward the back face of the end plate of the second scroll.

The arrangement also allows the cylinder member and the end plate of the second scroll to be put into successful close contact, which in turn contributes to successful oil delivery between the oil feed chamber and the communicating means.

Furthermore, it is preferable that the communicating means is open to an outer end portion of the spiral space formed by the spiral ridge of the second scroll.

The arrangement further allows the oil having been fed to the outer end portion of the spiral space of the second scroll to be subsequently introduced into the working chamber, thus enabling a successful sealing and lubrication in the axial direction between the second scroll and the first scroll.

It is preferable that the oil passage for introducing oil to the oil feed chamber is communicated with the center side chamber, and the communicating means makes the center side chamber communicated with the high-pressure working chamber present in the high-pressure range and also makes the oil feed chamber intermittently communicated with the working chamber lower in pressure than the high-pressure working chamber with which the center side chamber is communicated.

With this arrangement, as the second scroll revolves, the center side chamber is communicated with working chambers high in pressure via the communicating means. This communication causes the gas, which has been compressed to an intermediate pressure within the working chamber, to partly flow into the center side chamber through the communicating means, so that the center side chamber is held at an intermediate pressure between low and high pressures. On the other hand, the oil feed chamber also is intermittently communicated with the working chamber being located on the peripheral side and falling under the low-pressure range of an earlier stage of the compression, via the communicating means, as the second scroll revolves. As a result of this communication, due to a pressure difference between the working chambers and the oil feed chamber held at an intermediate pressure, the oil fed to the back side chamber after lubricating bearing parts is injected from the oil feed chamber into the working chambers via the communicating means. Yet also, since the injection of oil into the working chambers is effected intermittently only when the oil feed chamber is communicated with the working chamber, located in the low-pressure range on the peripheral side, via the communicating means, thus the quantity of oil fed to the working chambers will never become excessive.

The center side chamber formed on the back face of the end plate in the second scroll and the oil feed chamber are both partitioned from one portion of the inside of the sealed casing storing high pressure gas so as to be allowed to communicate with the working chambers via the communicating means provided to the end plate. Thus the center side chamber will never be subjected to high pressure, and therefore there is no possibility that the second scroll may be urged toward the first scroll strongly. As a consequence, the axial force of the second scroll toward the first scroll can be properly maintained.

Also, since the center side chamber is fed with a gas under the compression process so as to be held at an intermediate pressure, the oil flowing into the back side chamber after lubricating bearing parts is sequentially fed to the working chambers from the oil feed chamber via the communicating means. As a result, whereas an eccentric shaft portion of the crank shaft eccentrically rotates within the center side chamber, power loss generated due to the stirring of oil within the center side chamber is suppressed to a low level.

Further, it is preferable that the communicating means comprises at least one first communicating hole which makes the center side chamber communicated with the working chamber, and at least one second communicating hole which makes the oil feed chamber intermittently communicated with the working chamber, as the second scroll revolves.

With the above-described arrangement, by providing the end plate of the second scroll with a first communicating hole and a second communicating hole independently, it is made possible to locate the first communicating hole at a proper position irrespectively of the second communicating hole. Therefore, the pressure of the center side chamber can be easily set to any intermediate pressure, thus enabling an optimum oil injection from the oil feed chamber to the working chambers to be achieved.

Furthermore, it is preferable that the communicating means comprises one communicating hole which makes the center side chamber and the oil feed chamber alternately communicated with the working chamber, as the second scroll revolves.

With this arrangement, when the second scroll is provided with a single communicating hole, the single communicating hole can be used as both the aforementioned first and second communicating hole. Therefore, the machining of communicating holes can be much facilitated, allowing cost reduction.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
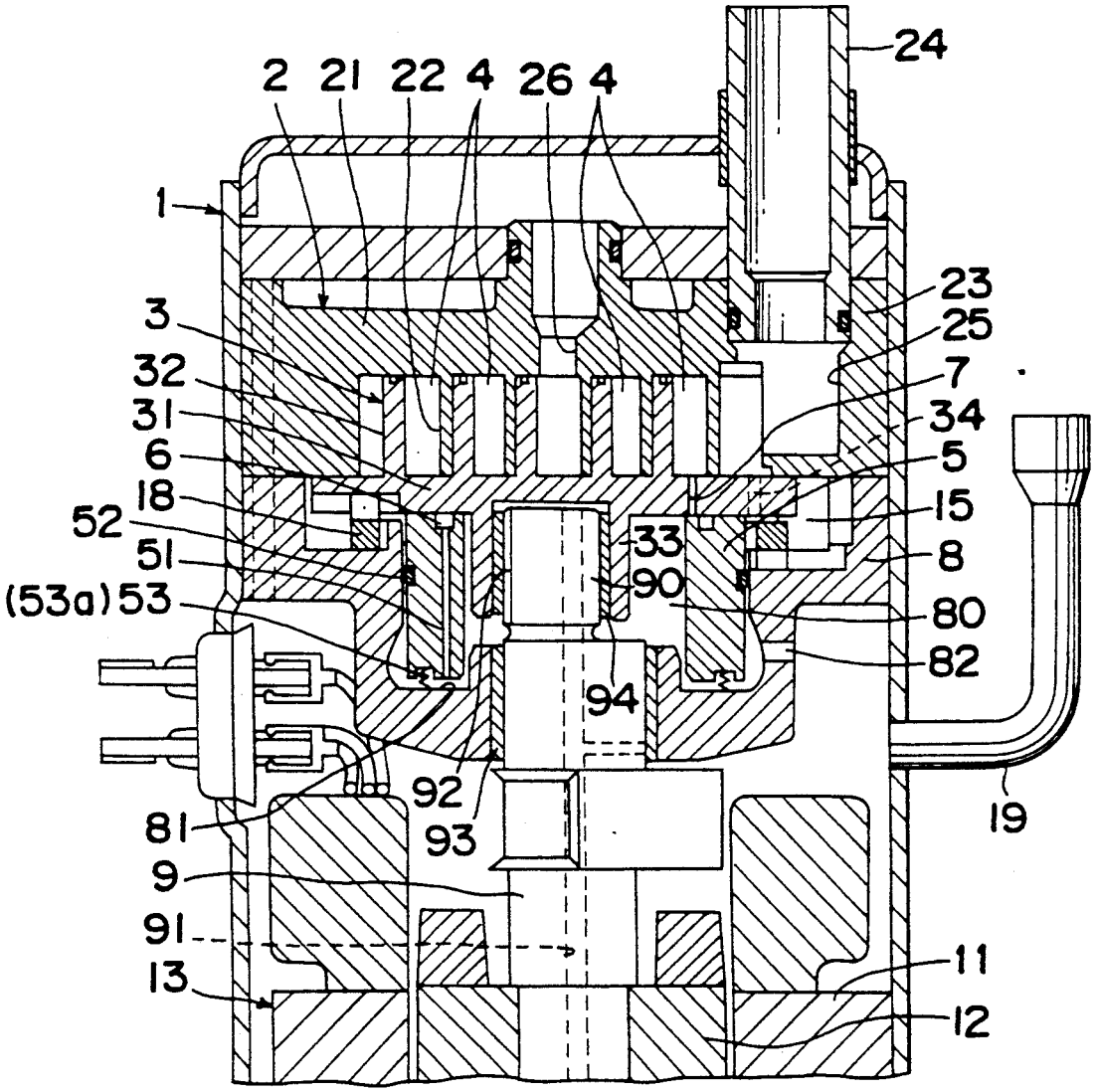
FIG. 1 is a sectional view showing an embodiment of a scroll type fluid machine according to the present invention.

A scroll type fluid machine as shown in FIG. 1 is constructed as described below. A sealed casing 1 of high-pressure resistant cylinder type is internally provided with a stationary scroll 2 as a first scroll, which has a spiral ridge 22 and a peripheral wall 23 connected thereto protrusively provided to the front face of an end plate 21, as well as a movable scroll 3 as a second scroll, which has a spiral ridge 32 protrusively provided to the front face of an end plate 31. The stationary scroll 2 and the movable scroll 3 are supported by a support member 8 secured to the inside of the sealed casing 1. To a boss cylinder 33 protrusively provided to the lower side of the movable scroll 3 there is fitted a crank pin part 90 of a crank shaft 9 extending from a motor 13 having a stator 11 and a rotor 12 while between the movable scroll 3 and the support member 8 there is installed an Oldham's ring 18 for arresting the rotation of the movable scroll 3. The movable scroll 3 is driven by the motor 13 to orbit; a low-pressure gas taken in an inlet port 25 of a spiral peripheral part through a suction pipe 24 is compressed within fluid working chambers 4 defined between the spiral ridges; and the compressed high-pressure gas is released into the sealed casing 1 through a discharge hole 26 provided at the spiral center of the stationary scroll 2, so that the gas is taken out to external via a discharge pipe 19.

With the above-described arrangement, between the back face of the end plate 31 of the movable scroll 3 and the support member 8 there is formed a back side chamber 80, in which is disposed cylinder member 5 which partitions the back face of the end plate 31 into a center side and a peripheral side, wherein a center side chamber is formed inside the cylinder member 5. To a contact surface of the cylinder member 5 with respect to the end plate 31 there is provided an oil feed chamber 6 formed by a ring groove surrounding the center of the end plate 31, while at the bottom of the back side chamber 80 in the support member 8 there is provided an oil sump 81, the arrangement being such that the oil sump 81 functions to collect oil drawn up from an unshown bottom oil sump along a feed hole 91 within the crank shaft 9 by an unshown oil pump of volumetric type or the like provided to the lower end of the crank shaft 9 and then flowing out via the upper end of the crank shaft 9 and a notch groove 92 of the crank pin part 90, and the oil flowing out after lubricating a main bearing 93 or a pin bearing 94, and that the oil sump 81 and the oil feed chamber 6 are communicated with each other via an oil passage 51 axially formed in the cylinder member 5. The boss cylinder 33 of the movable scroll 3 and the crank pin part 90 contained therein is housed in the center side chamber inside the cylinder member 5.

Further, to the end plate 31 of the movable scroll 3 there is formed an oil communicating passage 7 as a communicating means given by a straight through hole which is intermittently communicated with the oil feed chamber 6 as the movable scroll 3 revolves or orbits, and an outlet portion of the oil communicating passage 7 is communicated with the working chamber 4 located in an intermediate-pressure range on the way of the compression process.

In addition, to a peripheral portion of the cylinder member 5 there is provided an annular groove, to which an O-ring 52 is installed, so that it is made possible to axially seal a low-pressure peripheral side chamber 15, which is defined at a back-face peripheral portion of the end plate 31 of the movable scroll 3 and which is communicated with an inlet port 25 via a through hole 34 provided to an end plate 31, and the back side chamber 80 from each other.

Furthermore, on the back face of the cylinder member 5 there is provided an annular spring seat, where an urging means 53 given by a spring **53*a* is installed, so that it is made possible to put a contact surface at the upper end of the cylinder member 5 into close contact with the end plate 31 of the movable scroll 3**.

Also, the bottom of the back side chamber 80 is disposed below a rotation area of the crank pin part 90. In more detail, an oil sump 81 consisting of the bottom of the back side chamber 80 is formed by providing a concave groove recessed to such a low level that it will not interfere with the crank pin part 90 at any outward portion of a main bearing 93, while to the support member 8 defining the back side chamber 80 there is provided a discharge hole 82 which opens at an upper portion of the oil sump 81 for discharging oil which would collect in the rotation area of the crank pin part 90 to the bottom oil sump not shown in the figures through internal space of the sealed casing 1.

Thus, as the machine is put into working, high-pressure oil collected in the oil sump 81 and communicated with the inside of the sealed casing 1 via the feed hole 91 and the discharge hole 82 is elevated along the oil passage 51 so as to be introduced to the oil feed chamber 6 and, when the oil feed chamber 6 and the oil communicating passage 7 are communicated with each other as the movable scroll 3 revolves, the oil is injected into the fluid working chamber 4. In this arrangement, since it is not during the whole period of one revolution of the movable scroll 3 but during a partial short period thereof that the oil feed chamber 6 and the oil communicating passage 7 are communicated with each other, the resulting quantity of oil injected into the working chamber 4 via the oil communicating passage 7 is a limited one, preventing any excessive oil injection. Further since a period during which the oil communicating passage 7 is kept communicated with the oil feed chamber 6 can be easily set by determining a position at which the oil communicating passage 7 opens, the quantity of oil injected into the working chamber 4 can be controlled simply and properly.

Also, since the oil from the oil communicating passage 7 is injected into the working chamber 4 located in the intermediate-pressure range, the low-pressure gas taken in from the inlet port 25 can be prevented from being excessively heated by the injected oil, suppressing any reduction in volumetric efficiency. Moreover, since the oil is injected directly into the working chamber 4, the machine is ensured for its sealing characteristic promptly even at its start-up.

Still further, since the oil feed chamber 6 is formed by an annular ring groove, the sliding characteristic between the cylinder member 5 and the back face of the end plate 31 of the movable scroll 3 can be improved.

Moreover, since the oil sump 81 is provided by making use of the bottom of the back side chamber 80 in the support member 8 so that the oil collected in the oil sump 81 is injected into the working chamber 4 via the oil passage 51 provided to the cylinder member 5, the construction for oil injection can be simplified.

Yet since it is arranged that the oil collected in the oil sump 81, which is formed by lowering the bottom of the back side chamber 80, and the crank pin part 90 are prevented from interfering with each other and that any excessive oil is discharged into the bottom oil sump of the sealed casing 1 via the discharge hole 82, thus power loss due to the stirring of oil can be prevented.

Since the back face of the cylinder member 5 is arranged to be urged by the urging means 53, the cylinder member 5 and the end plate 31 of the movable scroll 3 can be put into successful close contact with each other, ensuring a successful delivery of oil between the oil feed chamber 6 and the oil communicating passage 7. With the O-ring 52 further installed in addition to the above arrangement, the high-pressure back side chamber 80 and a low-pressure peripheral side chamber 15 can be successfully sealed from each other, and the working area of high pressure made to act on the back face of the movable scroll 3 can be set at a proper level, thus allowing an upward thrust of the movable scroll 3 toward the stationary scroll 2 to be set at a proper level.

Figure 2:
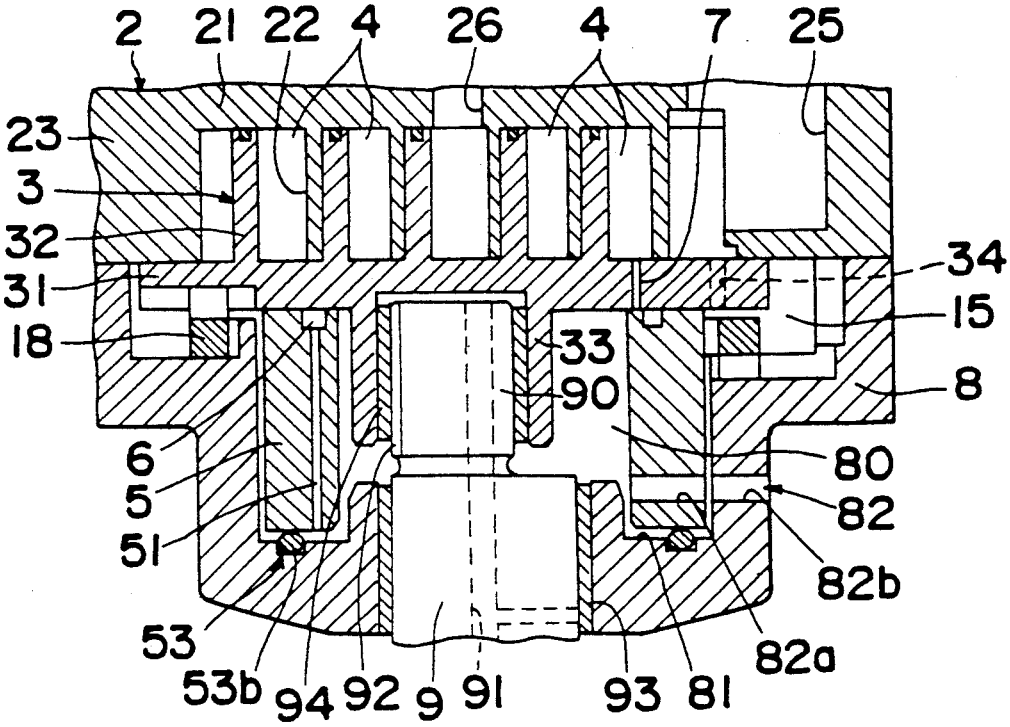
FIG. 2 is a main-part sectional view showing an embodiment of the invention.

As shown in FIG. 2, an O-ring **53*b* may also be employed instead of the spring 53*a* as the urging means 53, and the urging means 53 formed by this O-ring 53*b* may be installed within the groove provided at the bottom of the back side chamber 80. In this case, since the bottom of the oil sump 81 is partitioned into a inner peripheral side and an outer peripheral side by the O-ring 53*b* that forms the urging means 53, the discharge hole 82 is comprised of a first discharge hole 82*a*, which is provided to the cylinder member 5, and a second discharge hole 82*b*, which is provided to the support member 8, so that the back side chamber 80 and the inside of the casing 1** are communicated with each other.

Figure 3:
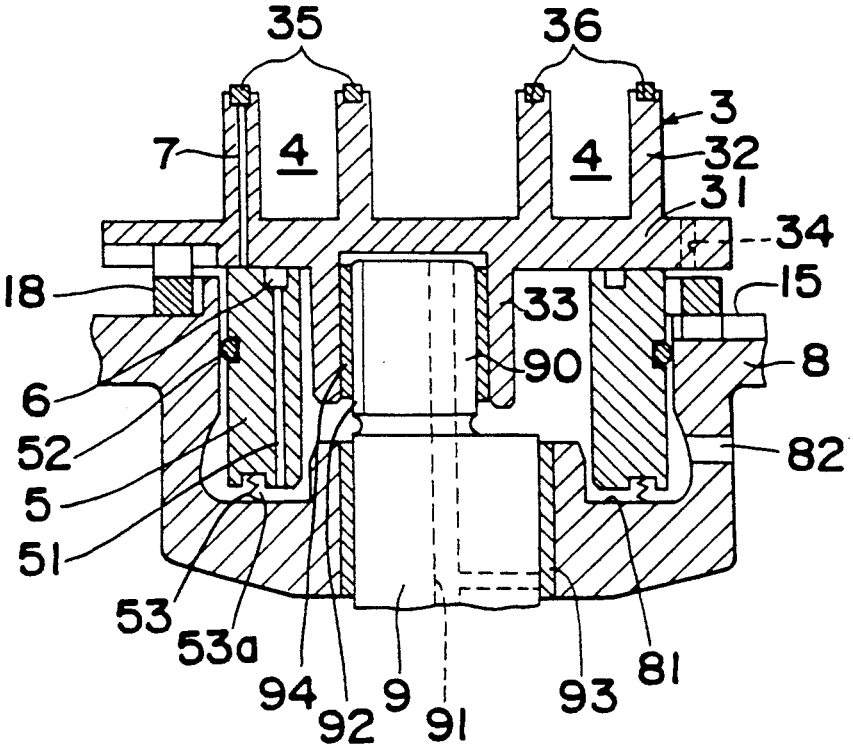
FIG. 3 is a main-part sectional view showing an embodiment of the invention.

Further, whereas the oil communicating passage 7 is arranged so that its outlet directly opens to the working chamber 4 via the flat portion of the end plate 31 of the movable scroll 3, it may also be arranged, as shown in FIG. 3, that the outlet of the oil communicating passage 7 opens to a fitting groove 36 of a tip seal 35 installed at the tip of the spiral ridge 32 of the movable scroll 3. In this case, oil having been fed to the tip seal 35 is subsequently injected into the working chamber 4, thus ensuring a successful sealing in the axial direction between the end face of the spiral ridge 32 of the movable scroll 3 and the end plate 21 of the stationary scroll 2.

Figure 4:
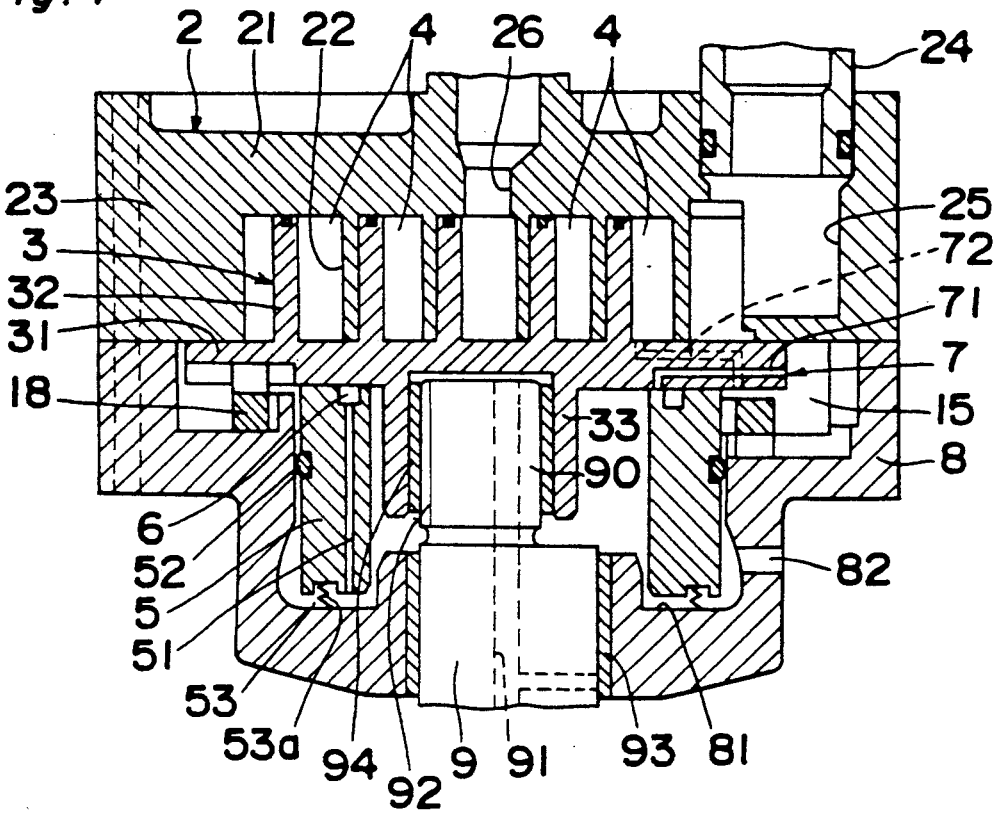
FIG. 4 is a main-part sectional view showing an embodiment of the invention.
Figure 5:
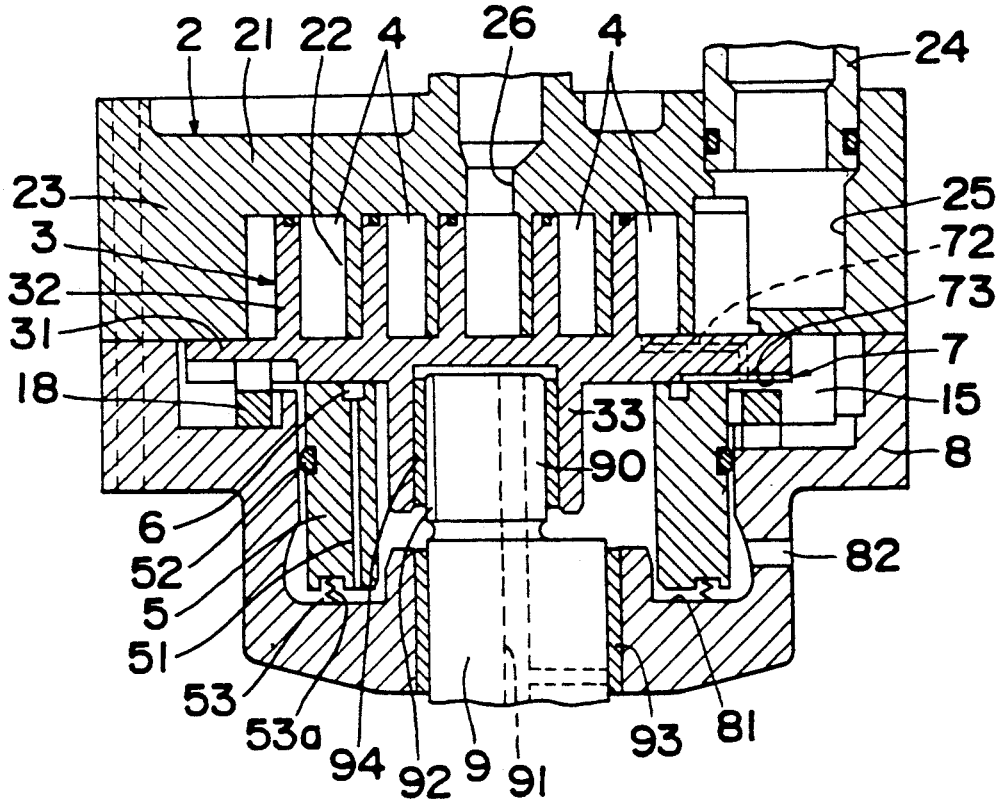
FIG. 5 is a main-part sectional view showing an embodiment of the invention.

In the above-described embodiments, the peripheral side chamber 15 on the spiral periphery of the movable scroll 3 is communicated with the inlet port 25 so as to be kept at low pressure, while the oil communicating passage 7 is opened directly or indirectly through the fitting groove 36 of the tip seal 35 to the working chamber 4 without passing via the peripheral side chamber 15. As an alternative be arranged as shown in FIG. 4 that a first hole 71 forming the first half of the oil communicating passage 7 is arranged to open to the periphery of the movable scroll 3 so as to allow the oil feed chamber 6 and the peripheral side chamber 15 to be communicated with each other while the peripheral side chamber 15 and the working chamber 4 are communicated with each other by a second hole 72 forming the remaining second half so that the peripheral side chamber 15 is maintained at an intermediate pressure lower than the high pressure and higher than the pressure of the working chamber 4 in the low-pressure range, and that injected oil is delivered via the peripheral side chamber 15, thereby allowing the lubrication of the Oldham's ring 18 to be carried out at the same time. In addition, the first hole 71 forming the first half of the oil communicating passage 7 in FIG. 4 may be replaced with an oil groove 73 provided to the back face of the movable scroll 3, as shown in FIG. 5.

Further, in the embodiments described above, although oil is injected into the fluid working chamber 4 in the intermediate-pressure range in order to prevent suction heating, oil may instead be injected at the inlet of the fluid working chamber 4 via the low-pressure inlet port 25. In this case, in connection with FIG. 1, the outlet of the oil communicating passage 7, for example, is arranged to open to the periphery of the end plate 31 of the movable scroll 3 or communicate with the through hole 34, while in connection with FIG. 4 or FIG. 5 the second hole 72 in the oil communicating passage 7 is formed into a straight through hole so as to be communicated with the inlet port 25. Otherwise without providing such second hole 72, there is opened a communicating hole at the bottom wall of the inlet port 25 in the stationary scroll 2, or the end plate 31 of the movable scroll 3 is reduced in outer diameter, so that the peripheral side chamber 15 and the inlet port 25 will be communicated with each other as the movable scroll 3 revolves.

According to these embodiments, it is possible to prevent any excessive oil injection into the fluid working chamber without using any capillary tube while the quantity of oil injected can be controlled simply and properly by adjusting the position at which the oil communicating passage opens.

According to these embodiments, it is also possible to prevent suction heating due to oil injection.

According to these embodiments, it is also possible to improve sliding characteristic between the cylinder member and the movable scroll.

According to these embodiments, it is also possible to simplify the passage construction for oil injection.

According to these embodiments, it is also possible not to cause power loss due to interference between the oil to be injected and the crank pin part.

According to these embodiments, it is also possible to accomplish a more successful delivery between the oil feed chamber and the oil communicating passage.

According to these embodiments, it is also possible to perform a successful sealing and lubrication in the axial direction between the movable scroll and the stationary scroll.

Figure 6:
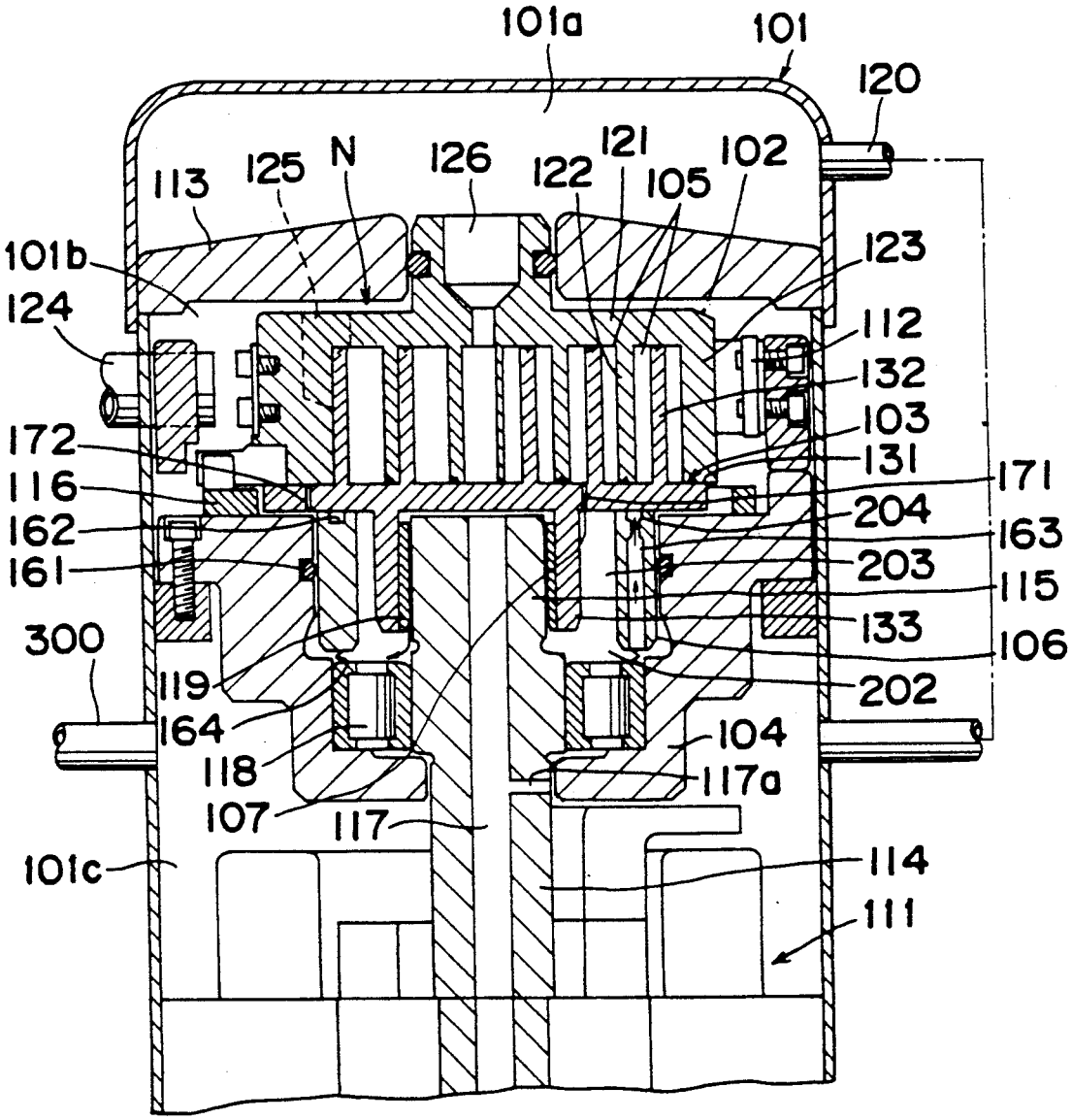
FIG. 6 is a sectional view showing an embodiment of a scroll type fluid machine according to the present invention.
Figure 7:
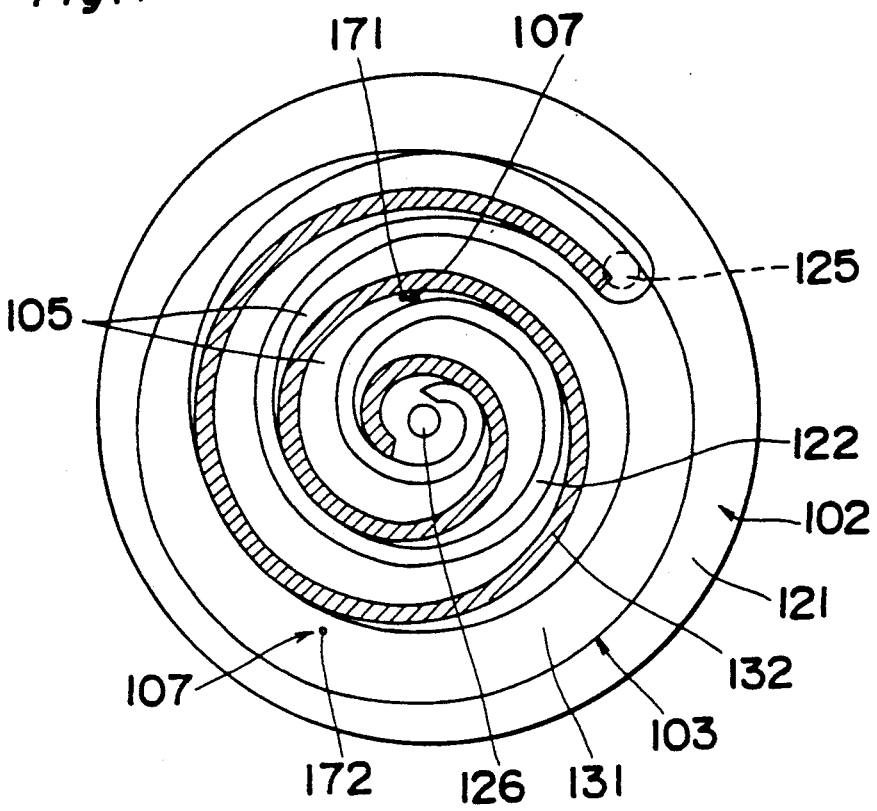
FIG. 7 is a transverse sectional view of a compression element in the above embodiment.

A scroll type fluid machine as shown in FIG. 6 and FIG. 7 is constructed as described below. At a lower portion within a sealed casing 101 there is provided a motor 111 having a stator and a rotor, while at an upper portion within the sealed casing 101 there is provided a compression element N composed of a first scroll 102, which has a spiral ridge 122 and a peripheral wall 123 connected thereto protrusively provided to an end plate 121, and a second scroll 103, which likewise has a spiral ridge 132 protrusively provided to an end plate 131, via a support member 104. The first scroll 102 is secured to the support member 104 with an elastic means 112, such as a plate spring. Between the spiral ridges 122 and 132 there are provided working chambers 105, which move with their volumes decreased from the periphery side to the center side as the second scroll 103 revolves with respect to the first scroll 102. The support member 104 is secured to the inner surface of the casing 101. Further, at an upper portion within the casing 101 there is provided a partition wall 113 so that the inside of the casing is partitioned into a chamber space 101*a*, and a space 101*b* for accommodating the compression element N, and there is formed a space 101*c* for accommodating the motor under the support member 104.

To a boss cylinder 133 protrusively provided to the lower side of the second scroll 103 there is fitted an eccentric shaft portion 115 of a drive shaft 114 extending from the rotor while between the first scroll 102 and the second scroll 103 there is installed an Oldham's ring 116 for arresting rotation of the second scroll 103. By revolution of the second scroll 103 with the motor 111 driven, low-pressure gas taken in an inlet port 125 on the spiral periphery from a suction pipe 124 via the space 101*b* is compressed in the working chamber 105 and then the compressed high-pressure gas is released to the chamber space 101*a* of the casing 101 through a discharge hole 126 provided to the spiral center of the first scroll 102 while the same high-pressure gas is introduced into the space 101*c*, in which the motor is accommodated, via a discharge by-pass pipe 120. Thereafter the gas is taken out to external through a discharge pipe 300 connected to the casing 101.

Also, to a core portion of the drive shaft 114 there is provided a feed hole 117 extending in the axial direction and opening at both shaft ends of the drive shaft 114 while the feed hole 117 has a branch hole 117*a* for feeding lubricating oil to a main bearing 118 installed between the drive shaft 114 and the support member 104 so as to extend in the radial direction. Lubricating oil collected in an oil sump not shown in the figures at the bottom of the casing 101 is drawn up by an oil pump (not shown) provided to the lower end of the drive shaft 114 through the feed hole 117. Thus the oil is released into the back side space of the end plate 131 after lubricating the main bearing 118 and an eccentric-shaft bearing 119.

In the scroll type fluid machine constructed as described above, in connection with the embodiment shown in the figure, a back side chamber 202 is defined on the back face of the end plate 131 of the second scroll 103 by the support member 104 independently of the space 101*c*, in which the motor is accommodated, of the casing 101, while a cylinder member 106 is installed on the back face of the end plate 131 of the second scroll 103 within the back side chamber 202.

Further, an O-ring 161 is installed between the outer peripheral face of the cylinder member 106 and the support member 104. Between the inner peripheral face of the cylinder member 106 and the outer peripheral face of the boss cylinder 133 there is provided a center side chamber 203 formed by defining the center side of the back side chamber 202 by the cylinder member 106. An annular groove 162 is formed on a contact surface of the cylinder member 106 with respect to the end plate 131, and within the groove 162 there is provided an oil feed chamber 204 partitioned from the center side chamber 203. Furthermore the oil feed chamber 204 and the center side chamber 203 are communicated with each other via an oil passage 163 formed in the axial direction of the cylinder member 106.

Figure 9:
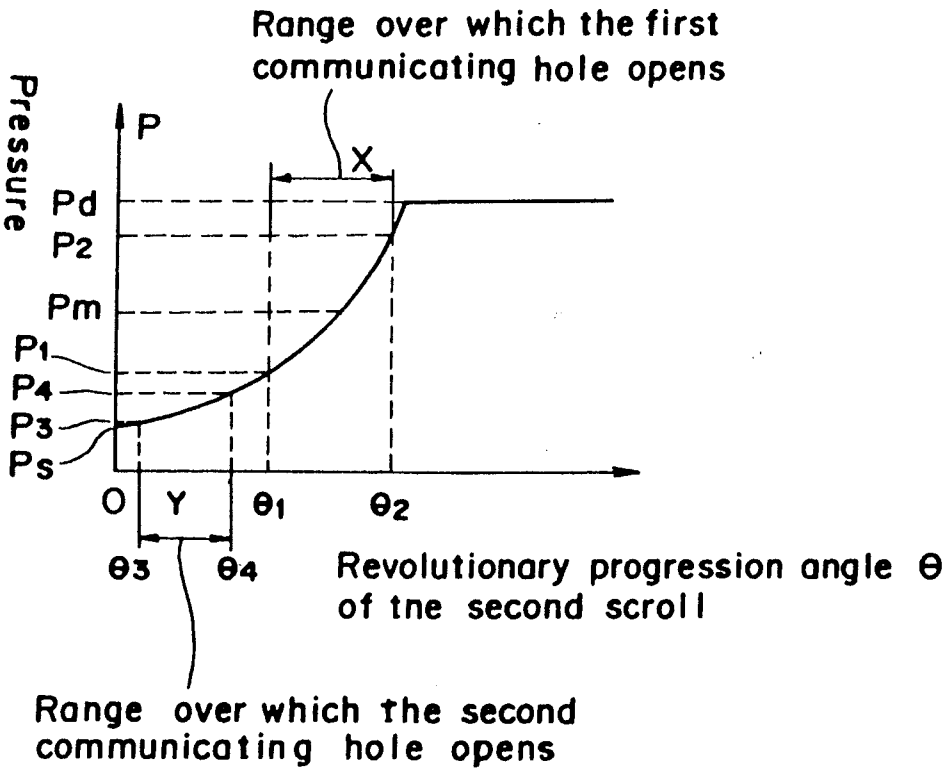
FIG. 9 is a view showing both a compression process through which gas taken in a suction chamber is increased in pressure with revolution angles of a second scroll and an angular range at which the communicating holes are communicated with working chambers in the compression process.

On the other hand, to the end plate 131 of the second scroll 103 there is provided communicating means 107 comprised of a first communicating hole 171, which makes the center side chamber 203 communicated with the working chamber 105 which is in the pressure stage of the compression process, and a second communicating hole 172, which makes the oil feed chamber 204 intermittently communicated with a working chamber 105 lower in pressure than the aforementioned working chamber 105 with which the center side chamber 203 is to be communicated, as the second scroll revolves. In this arrangement, at a stage of the compression process when the pressure of the working chamber 105 reaches $P_1$ as shown in FIG. 9 as the second scroll 103 revolves, the first communicating hole 171 is opened so that the center side chamber 203 is communicated with the working chamber 105, whereby high-pressure gas within the working chamber 105 is fed to the center side chamber 203, thus holding the center side chamber 203 at an intermediate pressure. The first communicating hole 171 is kept communicated with the working chamber 105 up to a stage of the compression process when the pressure of the working chamber 105 reaches $P_2$ as shown in FIG. 9, and thereafter closed. Accordingly, the working chamber 105 is communicated with the center side chamber 203 in a range X over which the working chamber 105 varies in pressure from $P_1$ to $P_2$, thus holding the center side chamber 203 at an intermediate pressure $P_m$ between the pressures $P_1$ and $P_2$. While the first communicating hole 171 is communicated with the working chamber 105, the second communicating hole 172 is not so communicated simultaneously but communicated with another working chamber lower in pressure or otherwise closed. Then when pressure of the working chamber 105 in the low-pressure range at an earlier stage of the compression process reaches $P_3$ as shown in FIG. 9 as the second scroll 103 revolves, the second communicating hole 172 is opened so that the oil feed chamber 204 is communicated with the working chamber 105, whereby lubricating oil in the center side chamber 203 is injected from the oil feed chamber 204 into the working chamber 105 due to pressure difference between the oil feed chamber 204 and the working chamber 105, while when the pressure of the working chamber 105 reaches $P_4$ as shown in FIG. 9, the second communicating hole 172 is closed. Accordingly, lubricating oil is injected from the oil feed chamber 204 into the working chamber 105 in a range Y over which the pressure of the working chamber 105 varies from the above-noted $P_3$ to $P_4$. In addition, although the first communicating hole 171 and the second communicating hole 172 are provided each one in number at positions displaced about 180° in FIG. 6 and FIG. 7, yet the positions where these communicating holes 171 and 172 are disposed are not particularly limited and besides they may be provided in any plural number instead of being provided one for each, as shown in FIG. 7. In FIG. 9, Pd is a discharge pressure, Ps is a suction pressure, and $P_m$ is the intermediate pressure of the back side chamber 202.

It is to be noted that, in the embodiment shown in the figures, between the lower face of the cylinder member 106 and a bottom of the support member 104 there is provided a spring 164 for urging the cylinder member 106 toward the end plate 131, so that a contact surface of the cylinder member 106 is put into close contact with the lower face of the end plate 131 of the second scroll 103.

As the fluid machine constructed as described above goes into working, the gas compressed to a high pressure within the working chamber 105 of the compression element N is discharged into the chamber space 101*a* of the sealed casing 101 through the discharge hole 126, introduced to the motor-accommodating chamber 101*c* along the by-pass pipe 120 connected to the sealed casing 101, and fed to external through the discharge pipe 300 while the oil collected in the unshown oil sump at the bottom of the sealed casing 101 is fed to the back side chamber 202 after lubricating the main bearing 118 and the eccentric-shaft bearing 119 via the feed hole 117 and the branch hole 117*a* by a feed pump.

Figure 8:
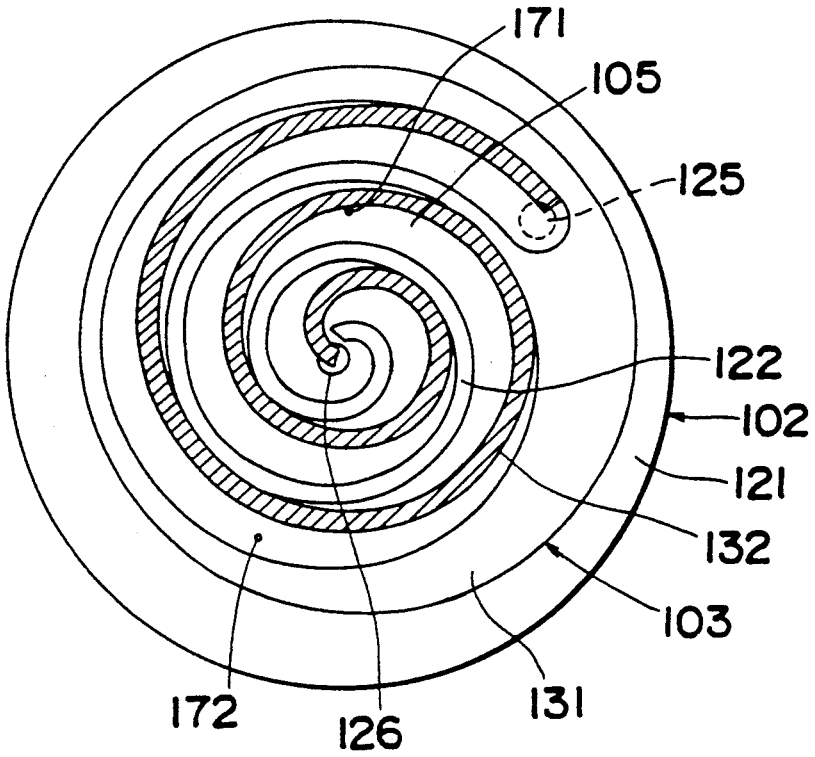
FIG. 8 is an explanatory view showing an operating state of the same compression element.

Thus as the second scroll 103 revolves with the fluid machine in operation, the pressure of the working chamber 105 under the compression process grows higher such that the first communicating hole 171 is opened to the center side chamber 203 in the range X in which the pressure varies from $P_1$ to $P_2$ as shown in FIG. 9 (state of FIGS. 7 and 8), thus allowing the high-pressure gas in the working chamber 105 to be partly fed from the first communicating hole 171 to the center side chamber 203. Accordingly, the center side chamber 203 can be set at an intermediate pressure and the oil feed chamber 204 is communicated with the center side chamber 203 via the oil passage 163 so that the oil feed chamber 204 is also controlled at the same intermediate pressure as the center side chamber 203. Therefore, when the working chamber 105 in the low-pressure range at an earlier stage of the compression process is communicated with the oil feed chamber 204 via the second communicating hole 172 (state of FIG. 8), the lubricating oil in the center side chamber 203 can be injected from the oil feed chamber 204 and the second communicating hole 172 into the working chamber 105 via the oil passage 163 due to pressure difference between the oil feed chamber 204, which is kept at the intermediate pressure, and the working chamber 105.

Moreover, since the injection of oil into the working chamber 105 is effected intermittently only when the oil feed chamber 204 is communicated with the working chamber 105 in the low-pressure range via the second communicating hole 172, the resulting quantity of oil injected into the working chamber 105 is limited so that any excessive oil injection to the working chamber 105 can be prevented. Also, since the first communicating hole 171 and the second communicating hole 172 are provided independently of each other, it is possible to set the location of the first communicating hole 171 with respect to the working chamber 105 properly irrespectively of the second communicating hole 172, allowing the pressure of the center side chamber 203 to be easily set to any intermediate pressure and thus ensuring an optimum oil injection from the oil feed chamber 204 into the working chamber 105.

Since the back side chamber 202 is fed with a high-pressure gas so as to be set at an intermediate pressure between the above-noted $P_1$ and $P_2$, the second scroll 103 is unlikely to be urged toward the first scroll 102 strongly, so that the axial force of the second scroll 103 toward the first scroll 102 can be held at a proper level.

Moreover, since the center side chamber 203 is fed with a high-pressure gas so as to be set at the aforementioned intermediate pressure, the lubricating oil flowing from the feed hole 117 into the center side chamber 203 after lubricating the bearing parts can be fed to the working chamber 105 successively from the oil feed chamber 204 and the second communicating hole 172 without being collected in the center side chamber 203 excessively. Accordingly, the center side chamber 203 can be prevented from being filled with oil, thus reducing power loss due to the stirring of oil within the center side chamber 203 even though the eccentric shaft portion 115 eccentrically rotates within the center side chamber 203.

Further in the embodiment of FIGS. 6 and 7, since the oil feed chamber 204 is provided to the contact surface of the cylinder member 106 with the end plate 131 of the second scroll 103, the oil flowing into the oil feed chamber 204 serves as lubrication between the cylinder member 106 and the back face of the end plate 131 of the second scroll 103, thus gaining a successful sliding characteristic of the second scroll 103 with respect to the cylinder member 106.

Although the first communicating hole 171 and the second communicating hole 172 are provided to the end plate 131 independently of each other in the embodiment described above, it may also be arranged that one communicating hole 173 is provided to the end plate 131, as shown in FIGS. 10 through 18, in which case the center side chamber 203 and the oil feed chamber 204 are alternately communicated with the working chamber 105 as the second scroll 103 revolves. Because the fluid machine as shown in FIGS. 10 through 18 is the same in basic construction as the one shown in FIGS. 6 through 8, the following description is made only upon their differences.

The communicating hole 173 is alternately opened to the center side chamber 203 or the oil feed chamber 204 while the second scroll 103 makes a 360° revolution, so that while opened to the center side chamber 203 it allows the high-pressure gas of the working chamber 105 to be fed to the center side chamber 203, and while opened to the oil feed chamber 204 it allows lubricating oil of center side chamber 203 to be injected into a working chamber 105 which is lower in pressure than the working chamber 105 and to which the center side chamber 203 is communicated.

Figure 19:
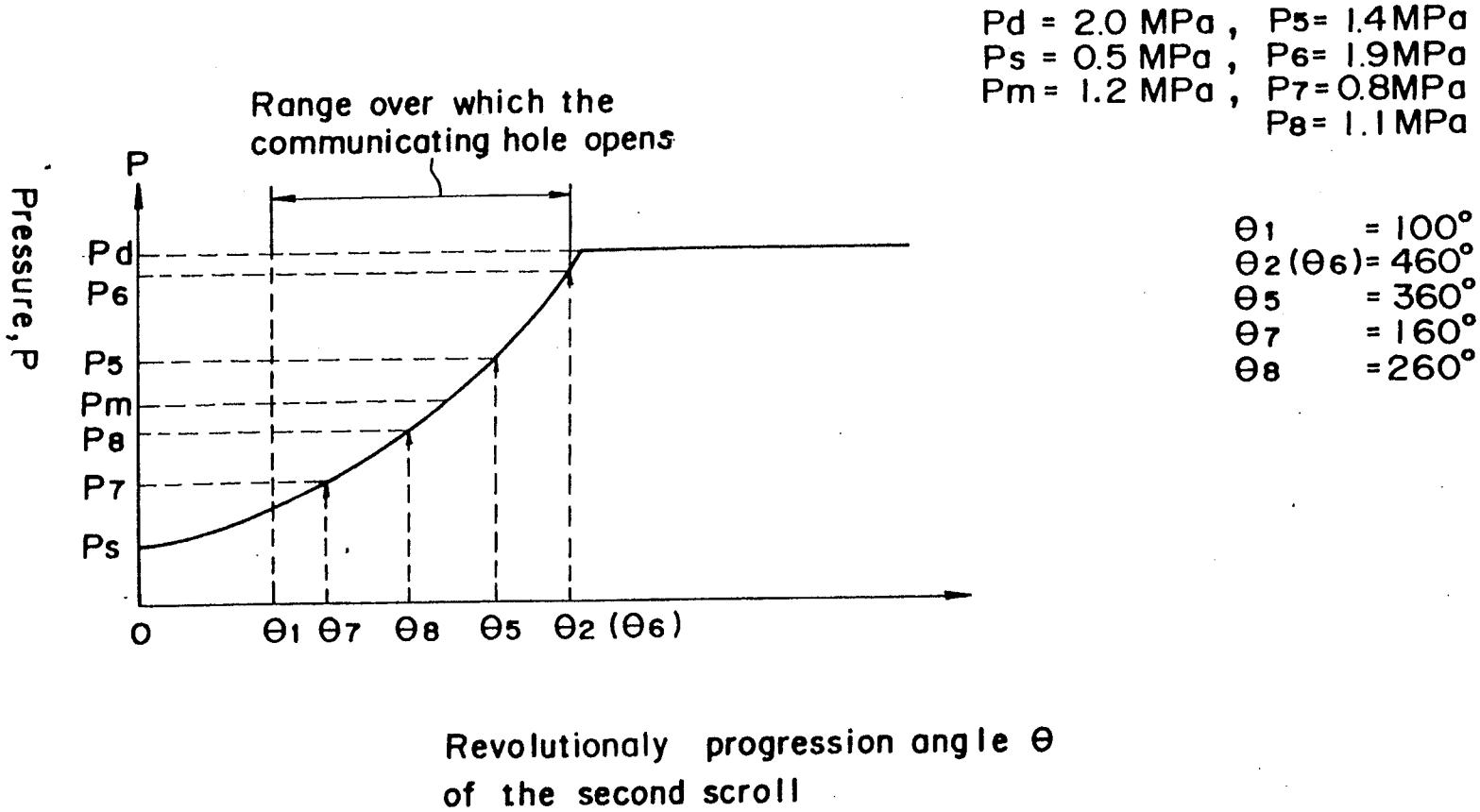
FIG. 19 is a view showing both a compression process through which gas taken in a suction chamber is increased in pressure with revolution angles of a second scroll and an angular range at which the communicating holes are communicated with working chambers in the compression process.
Figure 20:
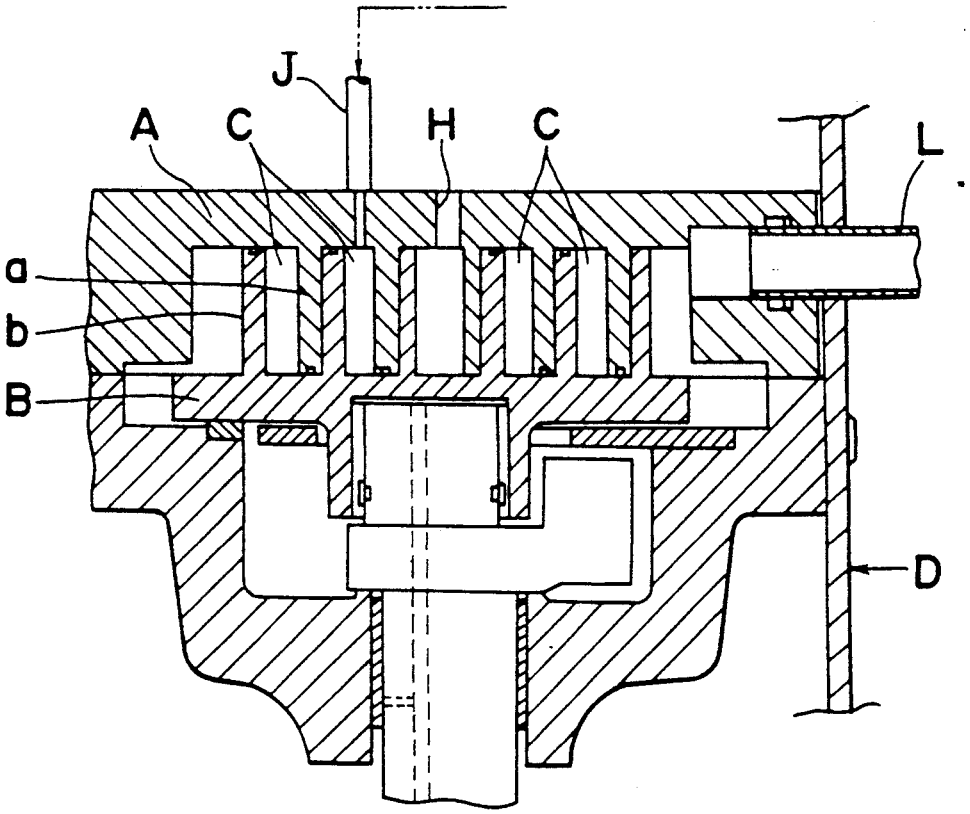
Fig.20 PRIOR ART
FIG. 20 is a main-part sectional view of a prior-art scroll type compressor.

In more detail, as the second scroll 103 revolves, the communicating hole 173 is opened to the center side chamber 203 at a stage of the compression process when the pressure of the working chamber 105 reaches, for example, $P_5$ as shown in FIG. 19 (state of FIG. 11), making the center side chamber 203 communicated with the working chamber 105 (state of FIG. 12), whereby the high-pressure gas of the working chamber 105 is partly fed to the center side chamber 203. The communicating hole 173 is communicated with the working chamber 105 up to a stage of the compression process when the pressure of the working chamber 105 reaches $P_6$ as shown in FIG. 19 (state of FIGS. 13 and 14), and thereafter closed. Thus the center side chamber 203 and the oil feed chamber 204, which is communicated with the center side chamber 203 via the oil passage 163, are both maintained at an intermediate pressure between the above-noted pressures $P_5$ and $P_6$. Further, the communicating hole 173 is opened to the oil feed chamber 204 at an earlier stage of the compression process when the working chamber 105 is located in the low-pressure range at an earlier stage of the compression process and its pressure reaches, for example, $P_7$ as shown in FIG. 19 (state of FIG. 15), making the oil feed chamber 204 communicated with the working chamber 105 (state of FIG. 16). Then lubricating oil of the center side chamber 203 is injected from the oil feed chamber 204 into the working chamber 105 due to pressure difference between the intermediate pressure of the oil feed chamber 204 and the pressure of the working chamber 105. The communicating hole 173 is kept communicated with the working chamber 105 up to a stage of the compression process when the pressure of the working chamber 105 reaches, for example, $P_8$ as shown in FIG. 19 (state of FIGS. 17 and 18), and thereafter closed to stop the oil injection into the working chamber 105. The pressure of the oil feed chamber 204 at this point becomes an intermediate pressure $P_m$ between the aforementioned pressures $P_8$ and $P_5$. In addition, in FIG. 19, Pd is the discharge pressure and Ps is the suction pressure.

Figure 10:
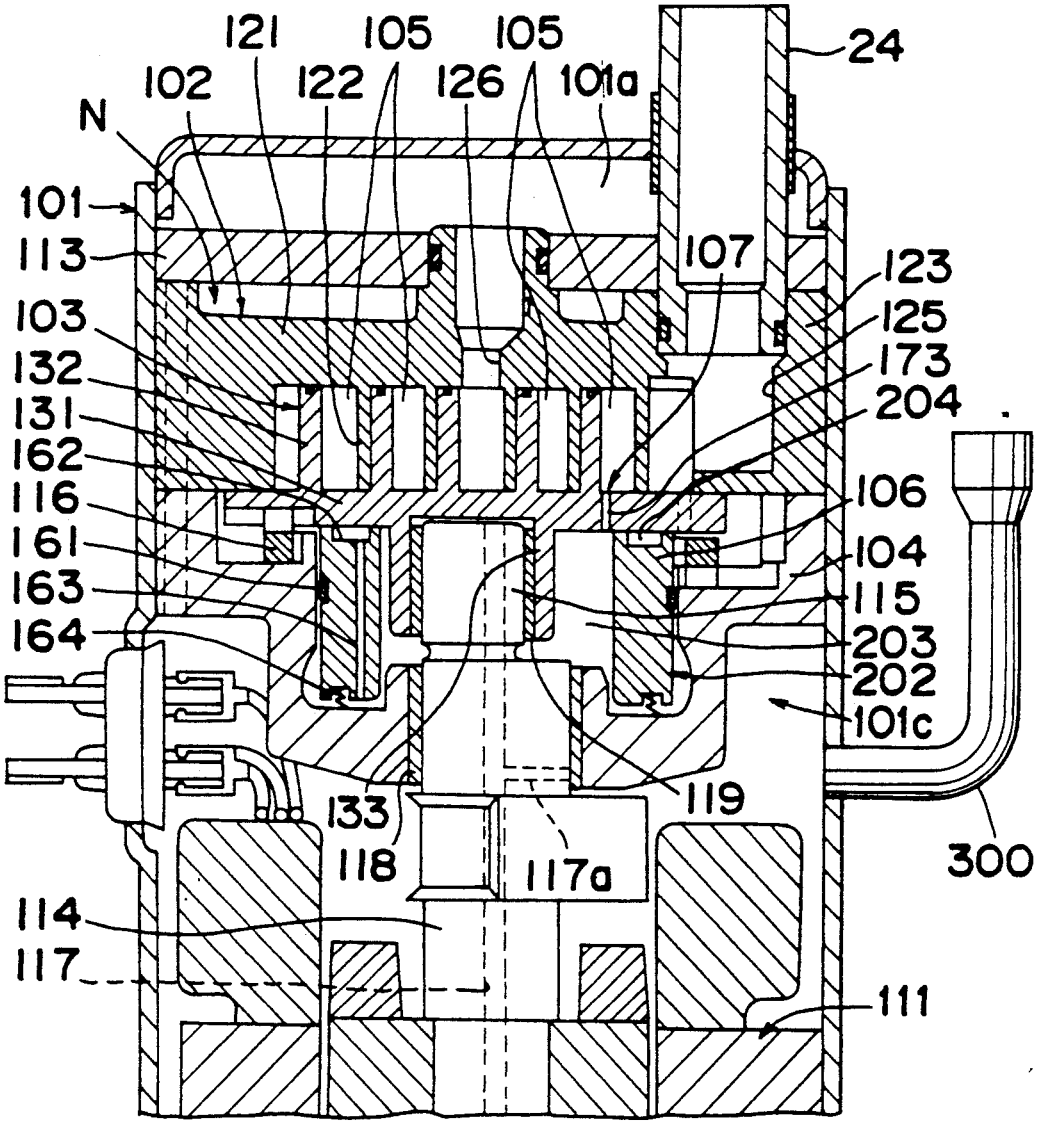
FIG. 10 is a sectional view of a scroll type fluid machine showing another embodiment of the invention.
Figure 11:
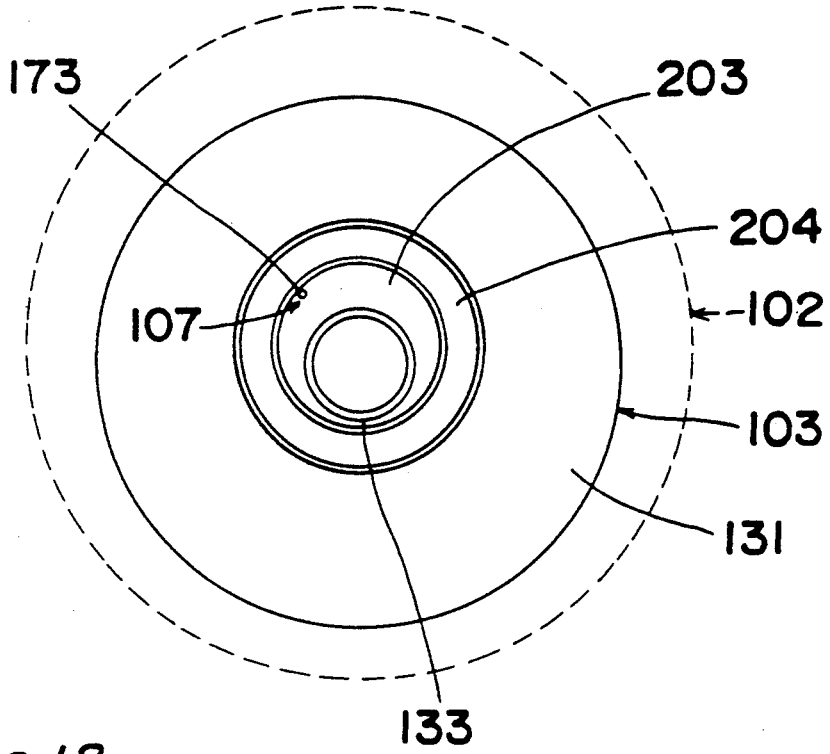
FIG. 11 is a transverse sectional view of a compression element in the above embodiment.
Figure 12:
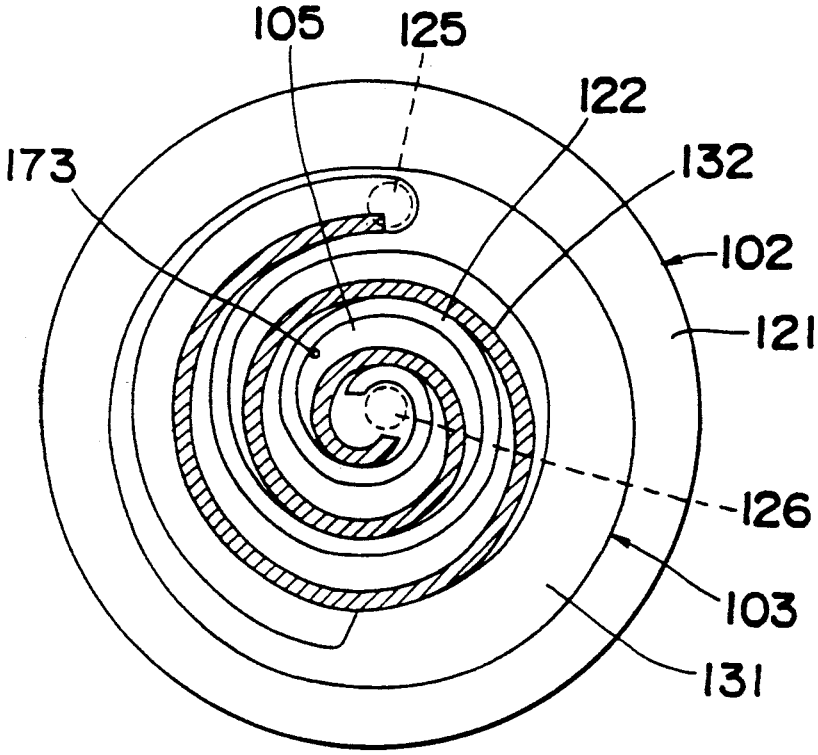
FIG. 12 is an explanatory view showing an operating state of the same compression element.
Figure 13:
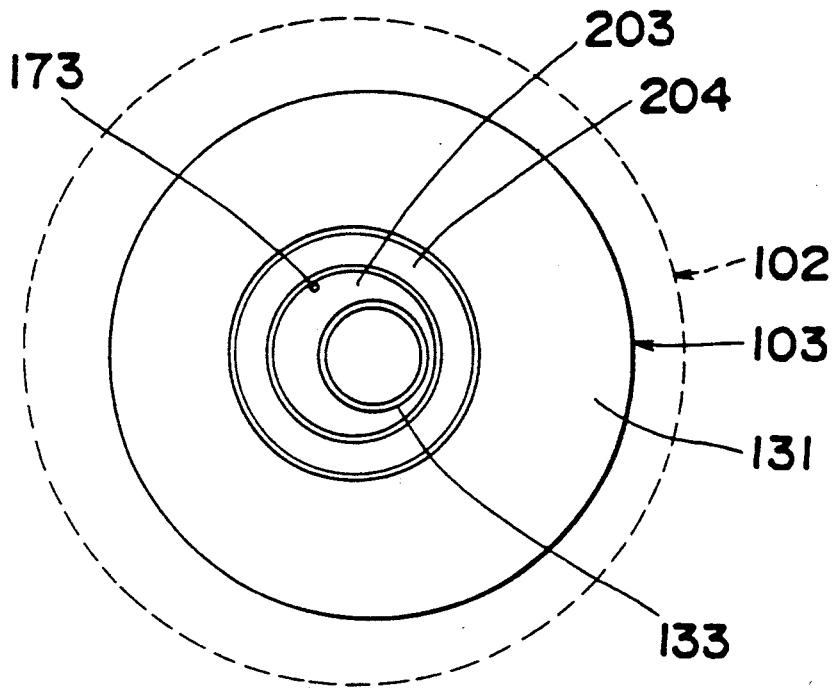
FIG. 13 is an explanatory view showing an operating state of the same compression element.
Figure 14:
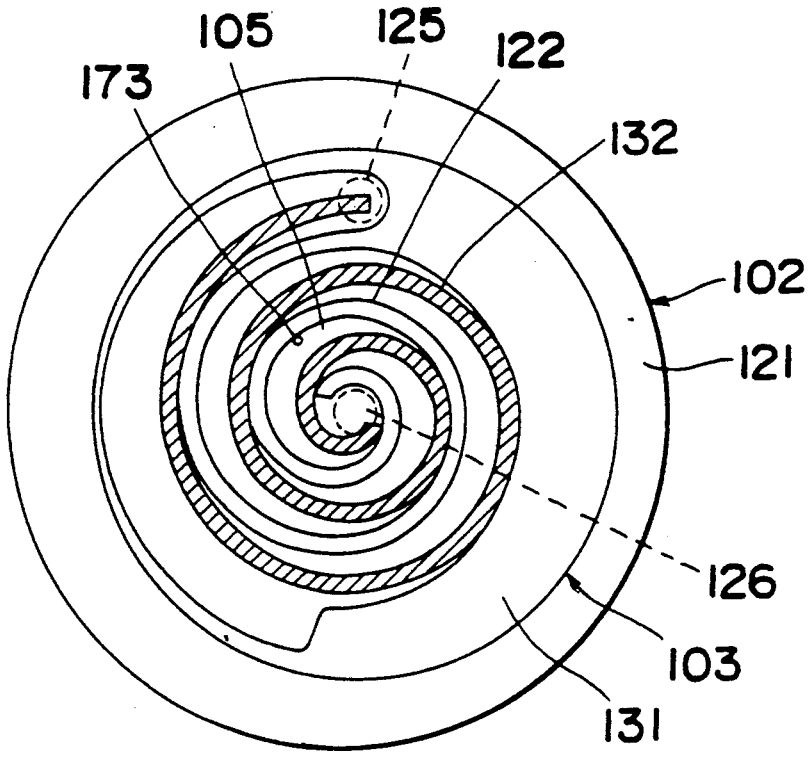
FIG. 14 is an explanatory view showing an operating state of the same compression element.
Figure 15:
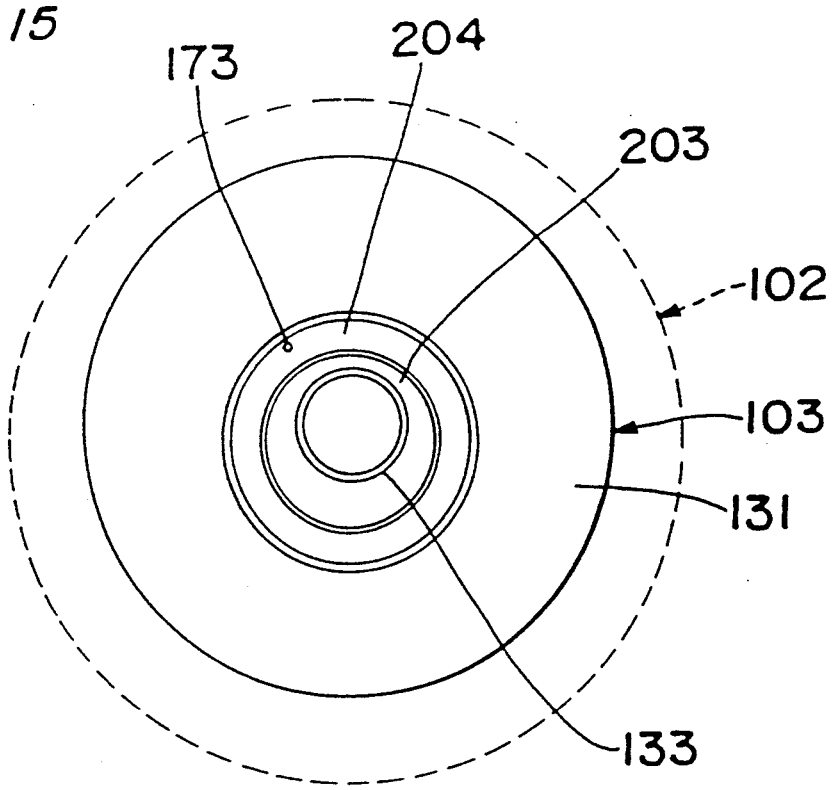
FIG. 15 is an explanatory view showing an operating state of the same compression element.
Figure 16:
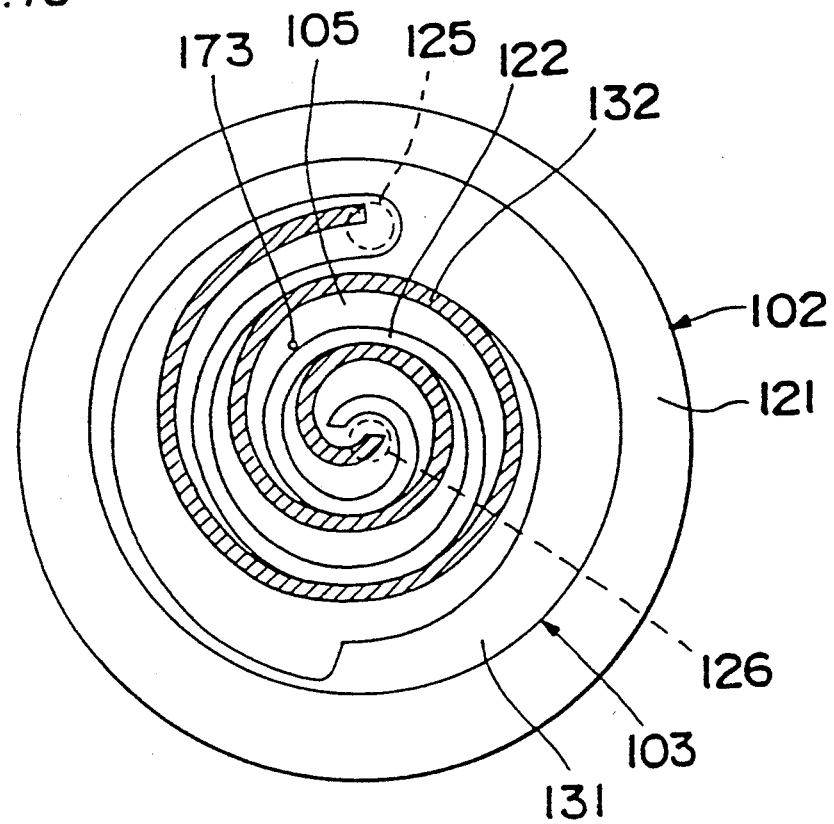
FIG. 16 is an explanatory view showing an operating state of the same compression element.
Figure 17:
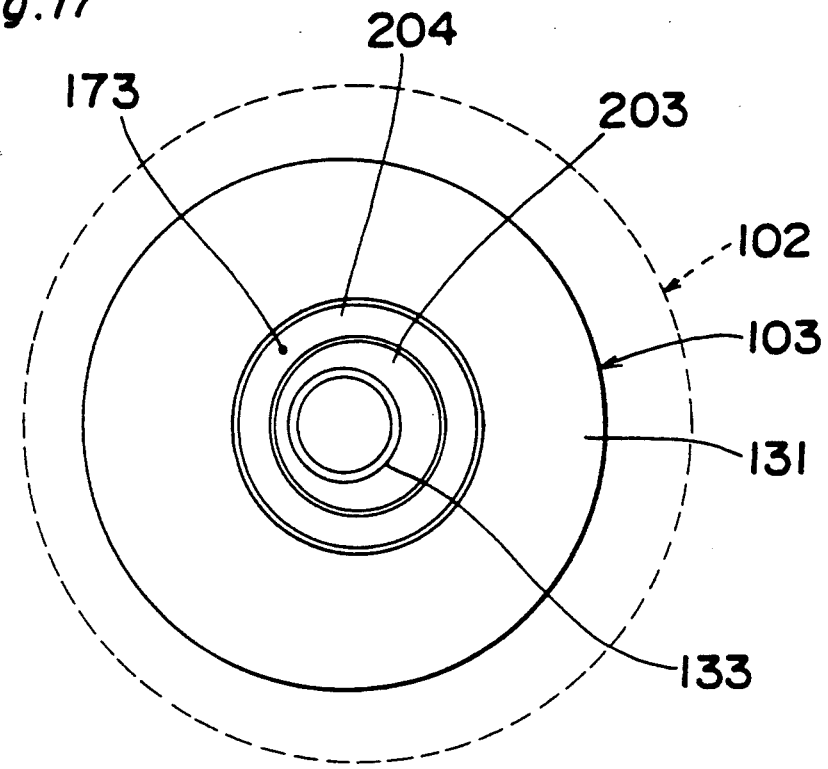
FIG. 17 is an explanatory view showing an operating state of the same compression element.
Figure 18:
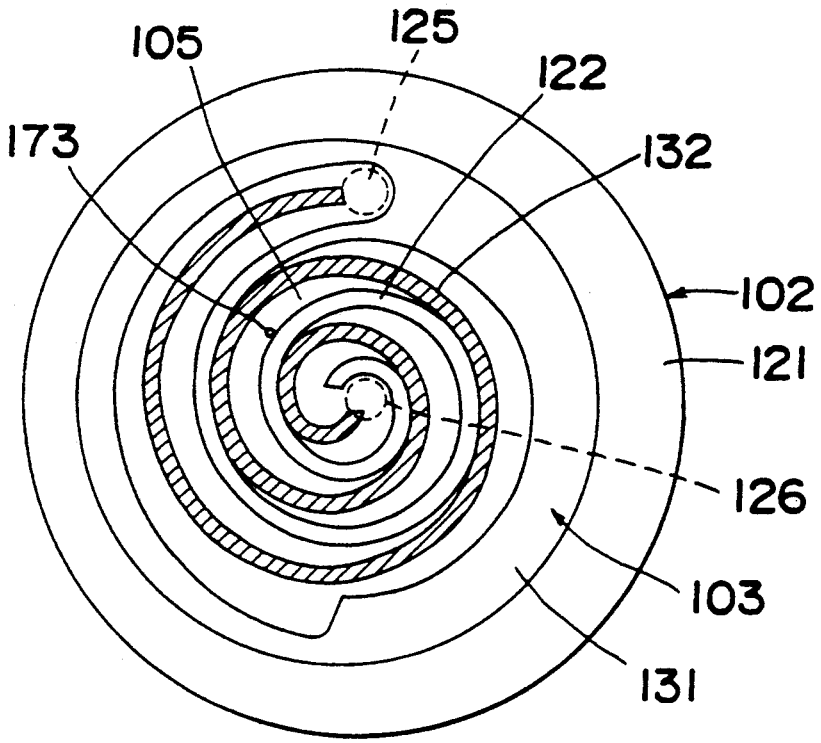
FIG. 18 is an explanatory view showing an operating state of the same compression element.

As described above, even in the case of FIGS. 10 through 19, the oil injection into the working chamber 105 is effected only when the oil feed chamber 204 is communicated with a working chamber 105 in the low-pressure range via the communicating hole 173, thus preventing any excessive oil injection into the working chamber 105 while the center side chamber 203 of the back side chamber 202 falls under the range from the intermediate pressure between the pressures $P_5$ and $P_6$ to the intermediate pressure between the $P_8$ and $P_5$, thus preventing the axial force of the second scroll 103 toward the first scroll 102 from becoming an excessively large one. Also the gas with a pressure of $P_5$ to $P_6$ is fed to the center side chamber 203 so that the center side chamber 203 is set at the intermediate pressure. Therefore, the lubricating oil flowing into the center side chamber 203 after lubricating the bearing parts can be fed to the working chamber 105 successively from the oil feed chamber 204 and the communicating hole 173 without being collected excessively in the center side chamber 203, thus preventing the center side chamber 203 from being filled with the lubricating oil. Moreover, since only one communicating hole 173 is provided, the machining of communicating holes can be facilitated, allowing cost reduction as compared with when a plurality of communicating holes are provided. In addition, although the fluid machine as shown in FIG. 10 is so arranged that the chamber space 101*a* of the casing 101 and the space 101*c* for accommodating the motor are communicated with each other by a communicating means so that the space 101*c* is also maintained at high pressure with the discharge pipe 300 opened to the space 101*c*, alternate construction may also be allowed such that the inside of the casing 101 will not have high pressure.

Further, in the embodiments of the fluid machine described above the first scroll 102 is fixed and the second scroll 103 is revolutionary; alternatively yet another one may be allowed the first and second scrolls 102 and 103 can be adapted to revolve around the shaft axis.

The scroll type fluid machine of the present embodiment is constructed as described above. That is, on the back face of the end plate 131 of the second scroll 103 there is provided the back side chamber 202 partitioned from the internal space of the casing 101 while the cylinder member 106 is provided in the back side chamber 202 to thereby form the center side chamber 203 and the oil feed chamber 204, with the oil passage 163 provided between the center side chamber 203 and the oil feed chamber 204. Moreover, to the end plate 131 there is provided the communicating means that allows the center side chamber 203 to be communicated with the working chamber 105 high in pressure and that also allows the oil feed chamber 204 to be intermittently communicated with a working chamber 105 lower in pressure than the working chamber 105 with which the center side chamber 203 is communicated, as the second scroll 103 revolves. Thus the center side chamber 203 is communicated with the working chamber 105 high in pressure via the communicating means as the second scroll 103 revolves, whereby the center side chamber 203 can be set at an intermediate pressure. Also the oil feed chamber 204 is communicated with the working chamber 105 in the low-pressure range at an earlier stage of the compression process via the communicating means, whereby the oil fed to the back side chamber 202 after lubricating the bearing parts is reliably injected into the working chamber 105 from the oil feed chamber 204 via the communicating means, due to pressure difference between the working chamber 105 and the oil feed chamber 204, which is communicated with the center side chamber 203 via the oil passage 163. Yet such injection of oil into the working chamber 105 is effected intermittently only when the oil feed chamber 204 is communicated with a working chamber 105 located in the low-pressure range via the communicating means, whereby the resulting quantity of oil injected into the working chamber 105 is limited such that any excessive oil injection into the working chamber 105 can be prevented.

Further, the center side chamber 203 and the oil feed chamber 204 formed on the back face of the end plate 131 of the second scroll 103 are maintained at an intermediate pressure without being subjected to high pressure. Thus the second scroll 103 is unlikely to be pressed strongly toward the first scroll 102, preventing the axial force of the second scroll 103 toward the first scroll 102 from becoming an excessive one.

According to the present embodiment, the center side chamber 203 is fed with a high-pressure gas such that the pressure of the center side chamber 203 is maintained at an intermediate pressure. Therefore the oil flowing into the back side chamber 202 after lubricating the bearing parts is fed to the working chamber 105 successively from the oil feed chamber 204 via the communicating means, so that the center side chamber 203 is prevented from being filled with oil and thus power loss due to the stirring of oil within the center side chamber 203 can be reduced even though the eccentric shaft portion of the drive shaft eccentrically rotates within the center side chamber 203.

Furthermore, to the end plate 131 of the second scroll 103 there is provided the first communicating hole 171 and the second communicating hole 172 independently of each other, allowing the first communicating hole 171 to be located at a proper position irrespectively of the second communicating hole 172. Therefore the pressure of the center side chamber 203 can be easily set to any intermediate pressure, ensuring an optimum oil injection from the oil feed chamber 204 into the working chamber 105.

Also when one communicating hole 173 is provided to the end plate 131 of the second scroll 103, this one communicating hole 173 can be used as both the first communicating hole 171 and the second communicating hole 172, much facilitating the machining of communicating holes and allowing cost reduction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scroll type fluid machine, comprising: a sealed casing; a first scroll disposed within said sealed casing, said first scroll having a first end plate, and a first spiral ridge provided on a front side of said first end plate; a second scroll disposed within said sealed casing, said second scroll having a second end plate, and a second spiral ridge provided on a front face of said second end plate; said first and second spiral ridges being interleaved with each other; said second end plate having a back face supported by a support member secured to said sealed casing, said support member having an oil sump provided therein; working chambers formed between said first and second spiral ridges, said working chambers varying from a low-pressure range on a peripheral side to a high-pressure range on a center side as volumes of said working chambers are decreased due to revolution of said second scroll relative to said first scroll;

a back side chamber formed between said back face of said second end plate and said support member;

a cylinder member disposed within said back side chamber such that said back face of said second end plate makes sliding contact with an end face of said cylinder member; a center side chamber formed inside said cylinder member within said back side chamber;

an oil feed chamber provided on said end face of said cylinder member so as to open to said back face of said second end plate;

an oil passage provided in said cylinder member for introducing oil from said oil sump into said oil feed chamber; and communicating means provided in said second end plate, said communicating means being in intermittent flow communication with said oil feed chamber, such that intermittent flow communication is provided from said oil feed chamber to said working chamber through said communicating means as said second scroll revolves.

2. The scroll type fluid machine as claimed in claim 1, wherein said communicating means is open to said working chamber when said working chamber is in an intermediate-pressure range.

3. The scroll type fluid machine as claimed in claim 1, wherein said oil feed chamber comprises a ring-shaped groove provided in said cylinder member surrounding a center of said second end plate.

4. The scroll type fluid machine as claimed in claim 2, wherein said oil feed chamber comprises a ring-shaped groove provided in said cylinder member surrounding a center of said second end plate.

5. The scroll type fluid machine as claimed in claim 1, wherein a bottom of said back side chamber is provided with said oil sump for receiving oil fed to a sliding part of a crank shaft which drives said second scroll, said oil sump being in flow communication with said oil passage of said cylinder member.

6. The scroll type fluid machine as claimed in claim 5, wherein said oil sump is disposed so as to be located below rotation range over which a crank pin part of said crank shaft rotates, and wherein said support member is provided with a discharge hole for discharging oil gathering in said rotation range of said crank pin part.

7. The scroll type fluid machine as claimed in claim 1, further comprising an urging means between said cylinder member and said support member, said urging means urging said cylinder member toward said back face of said second end plate.

8. The scroll type fluid machine as claimed in claim 1, wherein said communicating means is open to an outer end portion of spiral space formed by said second spiral ridge.

9. The scroll type fluid machine as claimed in claim 1, wherein said oil passage for introducing oil to said oil feed chamber is in flow communication with said center side chamber, and wherein said communicating means puts said center side chamber into flow communication with said working chamber when said working chamber is in the high-pressure range, and also puts said oil feed chamber into intermittent flow communication with said working chamber lower in pressure than said high-pressure working chamber with which said center side chamber is communicated.

10. The scroll type fluid machine as claimed in claim 9, wherein said communicating means comprises at least one first communicating hole which puts said center side chamber into flow communication with said working chamber, and at least one second communicating hole which puts said oil feed chamber into intermittent flow communication with said working chamber as said second scroll revolves.

11. The scroll type fluid machine as claimed in claim 9, wherein said communicating means comprises one communicating hole which puts said center side chamber and said oil feed chamber into alternate flow communication with said working chamber as said second scroll revolves.

12. The scroll type fluid machine as claimed in claim 1, wherein said communicating means opens to a fitting groove for a tip seal installed at a tip of said second spiral ridge.

* * * * *